US005862996A

United States Patent [19]

Crichton

[11] Patent Number: 5,862,996

[45] Date of Patent: Jan. 26, 1999

[54] LAMINAR FLOW NOZZLE

[75] Inventor: Jason M. Crichton, West Chester, Ohio

[73] Assignee: The Procter & Gamble Company, Cincinnati, Ohio

[21] Appl. No.: 781,769

[22] Filed: Jan. 10, 1997

[51] Int. Cl.[6] ..... B05B 1/30

[52] U.S. Cl. ..... 239/583; 239/584; 239/589; 239/590; 141/264; 141/286

[58] Field of Search ..... 239/589, 590, 239/590.3, 590.5, 583, 584, 461, 11; 141/264, 286

[56] References Cited

U.S. PATENT DOCUMENTS

| | | | |
|---|---|---|---|
| 915,214 | 3/1909 | Pfau | 239/583 |
| 968,711 | 8/1910 | Stevenson . | |
| 1,695,722 | 12/1928 | Smith . | |
| 1,994,389 | 3/1935 | Frisco | 299/131 |
| 2,005,598 | 6/1935 | Smith | 111/96 |
| 2,035,202 | 3/1936 | Smith | 239/583 |
| 2,083,584 | 6/1937 | Wineman | 102/6 |
| 2,289,432 | 7/1942 | Kammerer | 239/583 |
| 2,557,423 | 6/1951 | Fulpius | 239/583 |
| 2,570,629 | 10/1951 | Anxionnaz et al. | 60/35.5 |
| 2,599,622 | 6/1952 | Folmsbee | 137/53 |
| 2,622,612 | 12/1952 | Manhartsberger | 137/466 |
| 2,733,044 | 1/1956 | Danel | 253/24 |
| 2,870,944 | 1/1959 | Campbell | 222/509 |
| 2,904,877 | 9/1959 | Edelen | 29/157.1 |
| 2,925,102 | 2/1960 | Cummings et al. | 141/263 |
| 3,084,865 | 4/1963 | Fleer et al. | 236/99 |
| 3,095,154 | 6/1963 | Lange | 239/576 |
| 3,317,184 | 5/1967 | Usry | 251/122 |
| 3,335,921 | 8/1967 | Gellatly | 222/448 |
| 3,387,791 | 6/1968 | Allenbaugh, Jr. | 239/458 |
| 3,415,294 | 12/1968 | Kelly | 141/286 X |
| 3,511,442 | 5/1970 | De Luca et al. | 239/584 X |
| 3,738,611 | 6/1973 | Winders | 251/294 |
| 3,807,607 | 4/1974 | Kuckens | 222/481 |
| 3,902,815 | 9/1975 | Williams | 401/264 |
| 4,007,880 | 2/1977 | Hans et al. | 239/585 |
| 4,031,913 | 6/1977 | Apellaniz | 137/170.1 |
| 4,088,300 | 5/1978 | Suzuki et al. | 251/319 |
| 4,179,069 | 12/1979 | Knapp et al. | 239/125 |
| 4,316,481 | 2/1982 | Fillman | 137/302 |
| 4,365,746 | 12/1982 | Tanasawa et al. | 239/125 |
| 4,538,637 | 9/1985 | Williams | 137/360 |
| 4,648,421 | 3/1987 | Chant et al. | 137/312 |
| 4,651,931 | 3/1987 | Hans et al. | 239/533.9 |

(List continued on next page.)

FOREIGN PATENT DOCUMENTS

| | | |
|---|---|---|
| 149421 | 4/1937 | Austria . |
| 0528216 | 2/1993 | European Pat. Off. . |
| 1032514 | 7/1953 | France . |
| 1118478 | 6/1956 | France . |
| 1306708 | 9/1962 | France . |
| 2098782 | 3/1972 | France . |
| 2210567 | 7/1974 | France . |
| 2610305 | 8/1988 | France . |
| 2688196 | 10/1993 | France . |
| 2736339 | 10/1997 | France . |
| 71685 | 1/1893 | Germany . |
| 258378 | 5/1912 | Germany . |
| 2 300 752 | 8/1973 | Germany . |
| 4411629 | 2/1995 | Germany . |
| 426512 | 10/1947 | Italy . |
| 56-81255 | 7/1981 | Japan . |
| 1-142271 | 6/1989 | Japan . |
| 164621 | 12/1933 | Switzerland . |
| 240336 | 10/1925 | United Kingdom . |
| 2 225 382 | 5/1990 | United Kingdom . |

*Primary Examiner*—Andres Kashnikow
*Assistant Examiner*—Robin O. Evans
*Attorney, Agent, or Firm*—William Scott Andes

[57] ABSTRACT

Disclosed is a fluid flow nozzle for dispensing fluids from a container filling machine, the nozzle being capable of transforming substantially turbulent fluid flow to substantially laminar fluid flow. The nozzle includes a hollow housing which attaches to the filling machine, and a fluid exit port for dispensing fluid into containers. A torpedo-like member is positioned within the housing so as to restrict fluid flow through the nozzle in such a way as to dampen turbulence out of the fluid in the nozzle. An actuator located within the torpedo-like member functions so as to open and close the fluid exit port.

6 Claims, 5 Drawing Sheets

U.S. PATENT DOCUMENTS

| | | | |
|---|---|---|---|
| 4,688,609 | 8/1987 | Diaz | 141/82 |
| 4,884,720 | 12/1989 | Whigham et al. | 222/54 |
| 4,925,110 | 5/1990 | Takeda et al. | 239/533.12 |
| 4,974,565 | 12/1990 | Hashimoto et al. | 123/299 |
| 5,004,009 | 4/1991 | Bunce | 137/512.3 |
| 5,011,043 | 4/1991 | Whigham et al. | 222/63 |
| 5,025,991 | 6/1991 | Stainbrook et al. | 239/459 |
| 5,065,910 | 11/1991 | Fiedler | 222/504 |
| 5,085,354 | 2/1992 | Sogliani et al. | 222/504 |
| 5,094,278 | 3/1992 | Arao et al. | 239/590.5 X |
| 5,097,993 | 3/1992 | Davis | 222/509 |
| 5,213,260 | 5/1993 | Tonkinson | 239/590.3 X |
| 5,228,604 | 7/1993 | Zanini et al. | 222/504 |

LAMINAR FLOW NOZZLE

FIELD OF THE INVENTION

The present invention relates to nozzles for dispensing fluids into containers. The present invention has further relation to such nozzles that are able to provide laminar output flow.

BACKGROUND OF THE INVENTION

The presence of foam creation during filling of containers with liquid products is a significant barrier to increasing rates of filling for mass produced liquid product packing lines. Foaming also results in the need for large bottle head space, especially with low viscosity liquids, to insure that the foam will be contained when the container is full and will not spill over on to the outside surface of the container. This requires more container material to be used than would otherwise be necessary in the absence of foam creation. Applicant has determined that the dominant mechanism in foam creation is the impingement of flow stream surface perturbations upon the standing pool of liquid in the container as it is being filled. Turbulent flow from the filling nozzle is the source of these perturbations. Prior art nozzles have attempted to minimize perturbations, but with significant limitations; these prior art nozzles will be discussed in turn.

Downflow nozzles incorporating fine screens tend to reduce turbulent eddies in flowing fluids. The small orifice size in the screens accomplishes this by physical restriction of the eddies. However, this does not eliminate turbulence; it only reduces it. To some degree the screens become a source of new turbulence by "tripping" transitional flow into the turbulent regime. Screen maintenance is also a limitation due to clogging and breakage of the screen.

Overflow filling uses a nozzle that enters and seals with the top of the container; the product is allowed to overflow the container. Because foam is less dense than liquid, the foam rises to the top of the container and into the product overflow. There is no reduction in foaming, only a method of dealing with foam after its creation. This method adds time to the filling cycle; the overflow foam must be recycled via a recycle loop in the process, unless you choose to throw the overflow away.

Side ported nozzles work by extension of part of the nozzle into the container. The fluid is then gently directed toward the inside walls of the container and allowed to cascade down the walls creating laminar flow. The flow velocity (upon impingement with the standing pool of fluid) is also reduced since the flow's cross sectional area increases as it coats the inside of the container. This method is complex to execute because nozzle design is dependent on container geometry. Also, product cannot be filled to the top of the container because of the fact that the nozzle must enter the container.

Submerged filling works by submerging the nozzle tip beneath the fluid level in the container. This eliminates the turbulence producing interaction inherent in the flow stream/air/standing pool interface present with all other types of filling. The maximum rate is limited as the descending stroke of the nozzle reduces overall cycle time. Product spillage on the containers is also a concern because the exterior of the nozzle is wetted in this method. This method requires extra time to enter and exit the container with the nozzle, is mechanically complex resulting in more costly equipment, uses mesh filter screens which clog, and may result in product spillage on the nozzle and bottle which is unsightly and unsanitary.

Laminar flow maintenance nozzles maintain laminar flow from a laminar fluid source, such as a reservoir filler. There is no development of laminar flow, only maintenance of preexisting laminar flow. This is not compatible with filling sources that are inherently turbulent, such as piston or flow meter dosing technology. The nozzle disclosed in U.S. Pat. No. 5,228,604 by Zanini et al., incorporated herein by reference, is such a nozzle. The Zanini et al. nozzle is a downflow nozzle that works without screens, but it is meant for use exclusively with reservoir filling sources, and is unable to convert turbulent flow to laminar flow.

No fluid nozzle filling technology is known that provides for laminar flow when a turbulent fluid source is used. Thus, there exists a need for a fluid nozzle that will develop laminar fluid flow from a turbulent flow source. The benefits of the present invention include that it provides for faster filling line speed, and a smaller necessary head space in the container which allows a reduction in the amount of container material.

SUMMARY OF THE INVENTION

Disclosed is a fluid flow nozzle for dispensing fluids from a container filling machine, the nozzle being capable of transforming substantially turbulent fluid flow to substantially laminar fluid flow. The nozzle includes a hollow housing which attaches to the filling machine at a first end thereby providing fluid communication between the filling machine and the nozzle, the hollow housing forming an inner chamber. The nozzle also has a fluid exit port at a second end for dispensing fluid into containers. A torpedo-like member is positioned within the chamber so as to restrict fluid flow through the nozzle in such a way as to dampen turbulence out of the fluid in the nozzle. An actuator located within the torpedo-like member functions so as to open and close the fluid exit port. The actuator may be attached to a reciprocating sealing member, the reciprocating sealing member being capable of opening and closing the fluid exit port through operation of the actuator. Generally, fluid in the nozzle accelerates through the nozzle as the fluid flows past the torpedo-like member.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE INVENTION

Figure 1A:
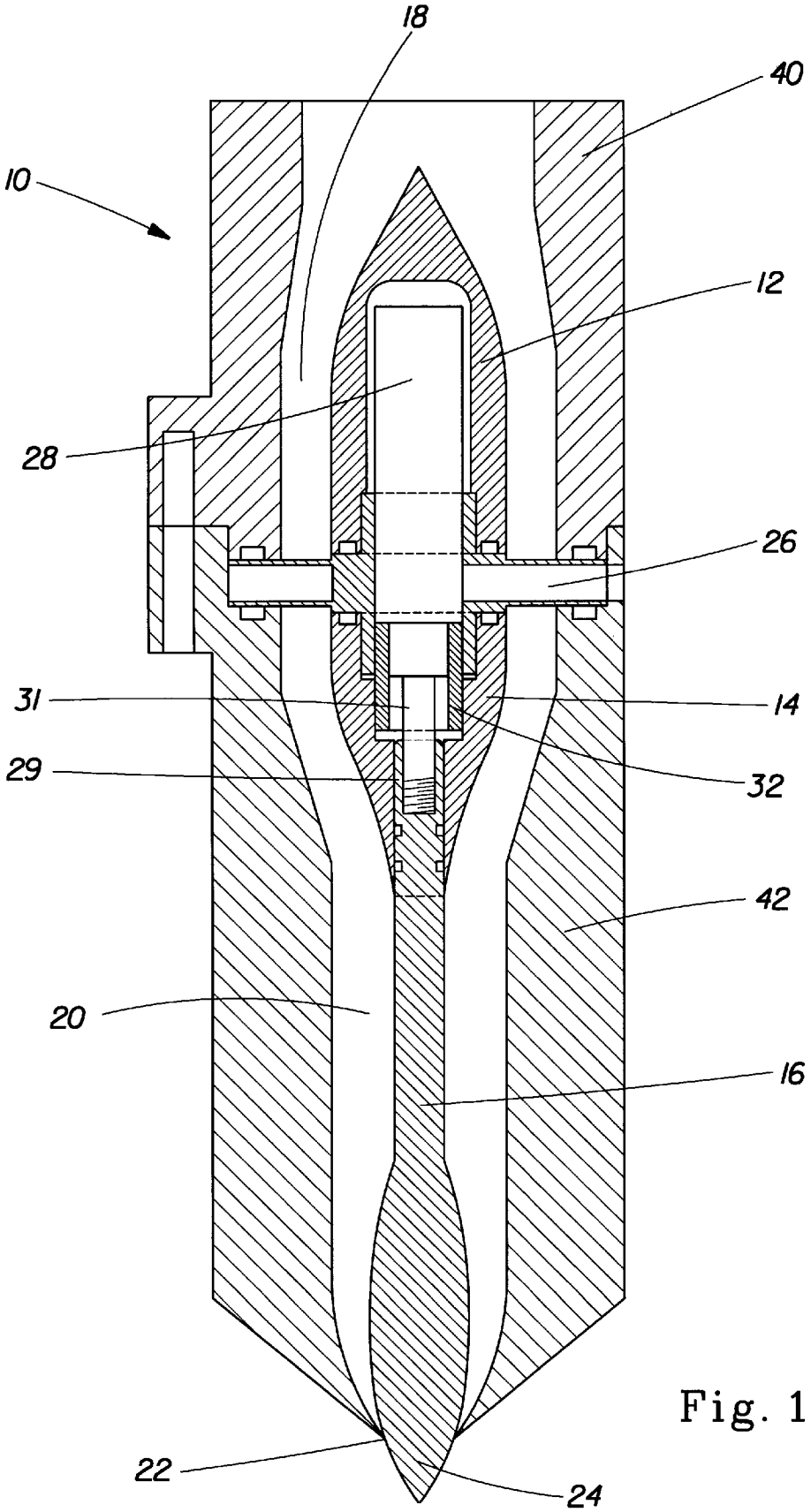
FIG. 1A is an elevational view of an embodiment of the present invention in the closed position.

Referring now to the drawings in detail wherein like numerals indicate the same element throughout the views, there is shown in FIG. 1A an embodiment of the nozzle of the present invention 10. The present device significantly reduces the amount of foam created while filling a container with fluid. It develops laminar flow from a turbulent source, such as a piston-type filler or a flow meter filler. If a reservoir or gravity fed filler source is used, the present device will maintain laminar flow. It manipulates the flow stream so that laminar flow is developed and maintained as it exits the nozzle. Unchecked, turbulent eddies will develop into flow perturbations on the circumferential surface of the flow stream. The interaction of these perturbations with the standing pool of liquid in the container have been determined to be the dominant mechanism of foam creation during filling. By developing and maintaining laminar flow, the negative effects of turbulence are eliminated. Additionally, Applicant has found that designing nozzle 10 so as to provide generally for acceleration of fluid flow through the nozzle, aids in transforming turbulent flow to laminar flow; in any event it is desirable to avoid any sudden deceleration of fluid flow through the nozzle.

There are two general regions to nozzle 10. The region around upper shroud 12 and lower shroud 14 is where laminar flow is developed; the region around center stem 16 is where laminar flow is maintained. Upper chamber 18 contains the flow and defines the flow annulus in this area. It diffuses the flow from the standard diameter at the top of the nozzle through the annulus area around shrouds 12 and 14.

Lower chamber 20 contains the flow and defines the flow annulus subsequent to transformation from turbulent to laminar flow. It converges the flow at nozzle exit port 22 to a given diameter (as defined by the container opening). Exit port 22 acts as a valve seat for center stem sealing end 24.

Figure 2:
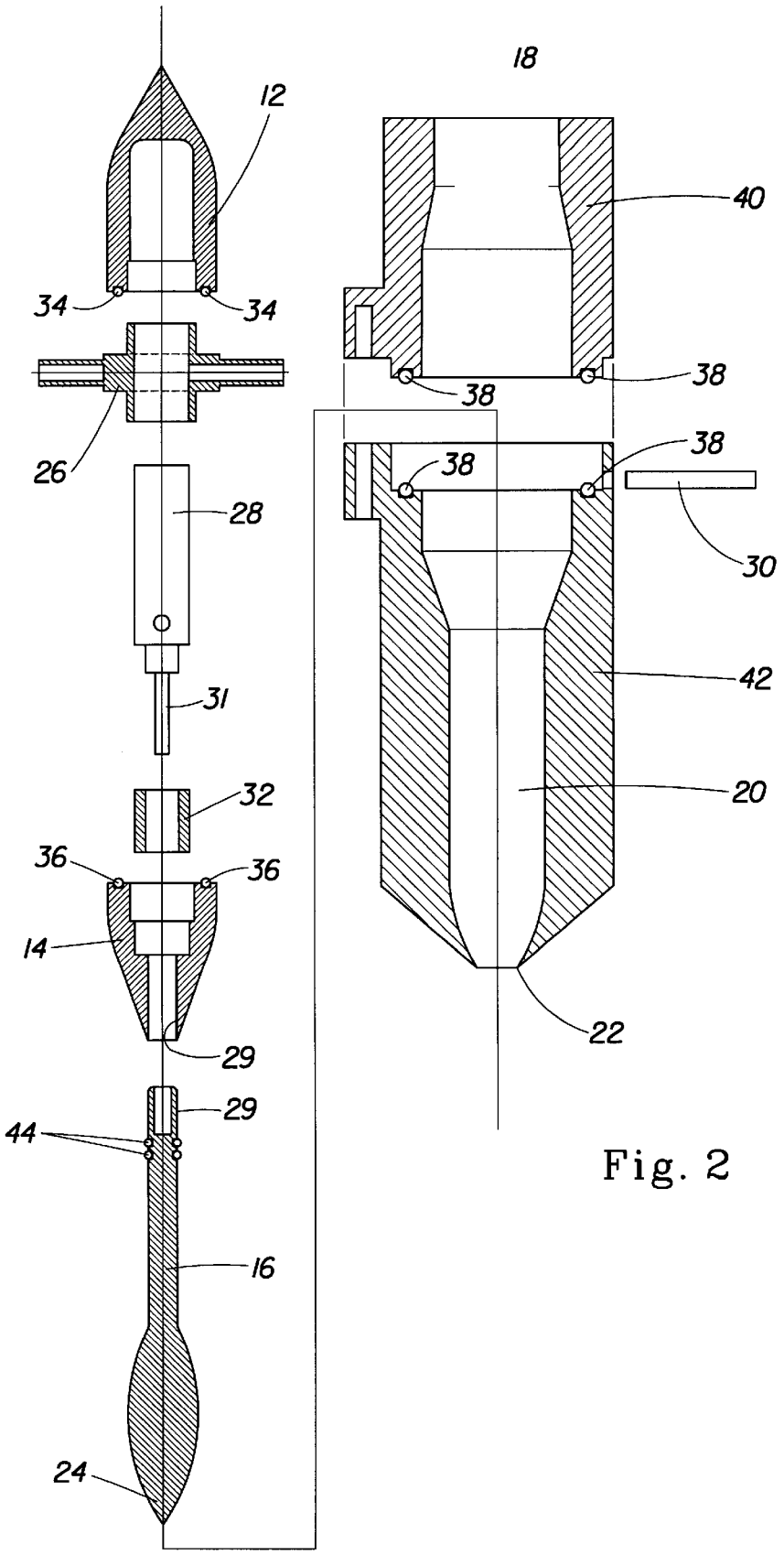
FIG. 2 is a disassembled view of the component parts of the embodiment of FIG. 1.

Middle shroud 26 provides a fixture for pneumatic actuator 28, upper shroud 12, and lower shroud 14. It provides for centering of center stem 16 and pneumatic actuator 28, and provides air access to and from pneumatic actuator 28 from outside of nozzle 10. FIG. 2 shows air port tube 30 and the channel through middle shroud 26 that allows the tube 30 to connect with actuator 28. Air port tube 30 provides a sealed passage for air into and out from pneumatic actuator 28. Actuator piston 31 is connected to center stem 16 by threads as shown, or by other connecting means. Shrouds 12 and 14 may be connected to middle shroud 26 by screw threads, by press fitting, or by other connecting means. The function of actuator 28, may be achieved by a small electric motor, a magnetic field exterior to the nozzle's main chambers acting upon an internal responsive actuator, or by other means known to the art.

Figure 1B:
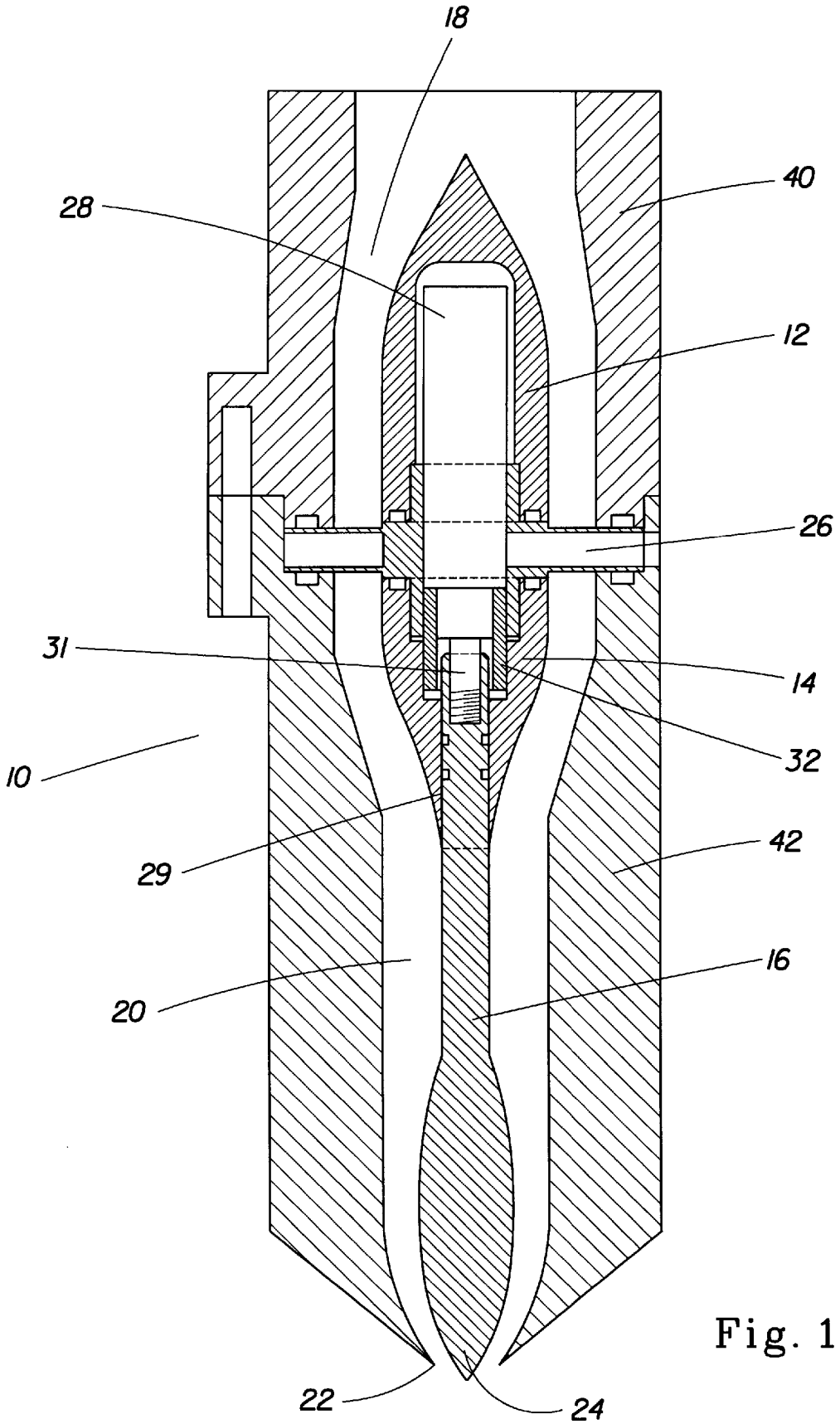
FIG. 1B is an elevational view of an embodiment of the present invention in the open position.

Upper shroud 12 and lower shroud 14 provide a streamlined capsule for pneumatic actuator 28 and define the inner diameter of the flow annulus. Bearing surface 29 keeps center stem 16 aligned with the longitudinal axis of nozzle 10, which provides for a good seal between sealing end 24 and exit port 22. This seal stops fluid flow when sealing end 24 is seated into lower chamber exit port 22. Spacer 32 is necessary for assembly spacing, and fixes the position of actuator 28 with respect to lower shroud 14. Actuator 28 provides linear actuation for center stem 16, thereby opening (see FIG. 1B) and closing nozzle 10; its location provides for easy use with non-reservoir systems.

Referring to FIG. 2, upper shroud O-rings 34 provide for a static seal between upper shroud 12 and middle shroud 26. Lower shroud O-rings 36 provide for a static seal between lower shroud 14 and middle shroud 26. Housing O-rings 38 provide for a static seal between upper chamber housing 40 and middle shroud 26, and middle shroud 26 and lower chamber housing 42. Dynamic O-rings 44 provide for a dynamic seal between lower shroud 14 and center stem 16.

Figure 3A:
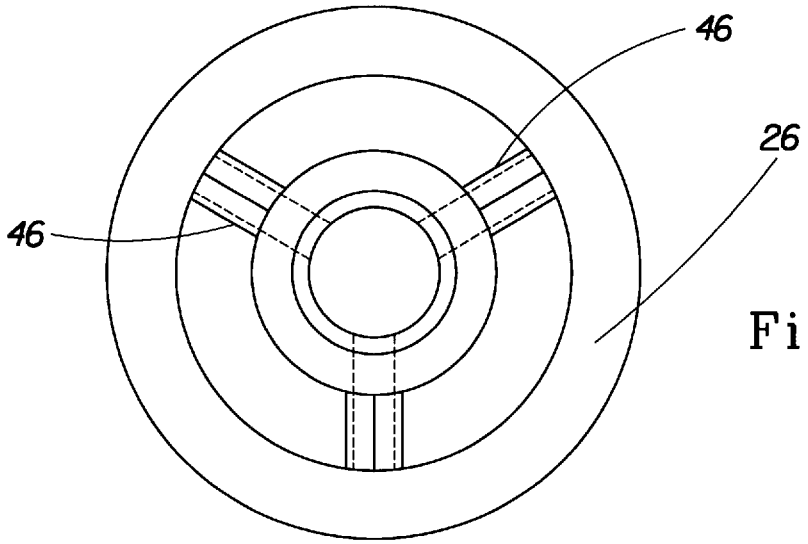
FIG. 3A is a plan view of the middle shroud of the embodiment of FIG. 1.
Figure 3B:
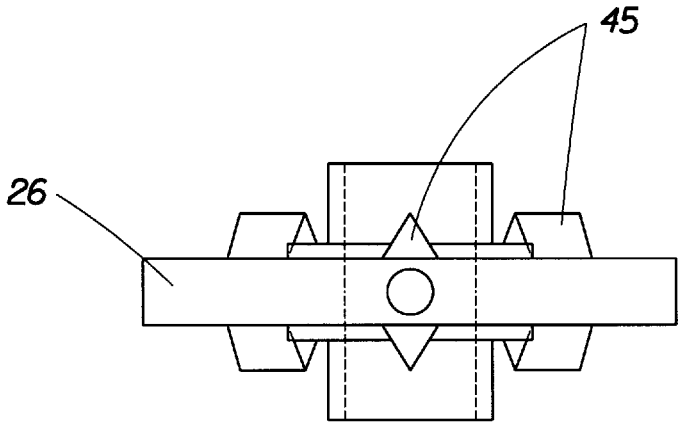
FIG. 3B is an elevational view of the middle shroud of the embodiment of FIG. 1.
Figure 4:
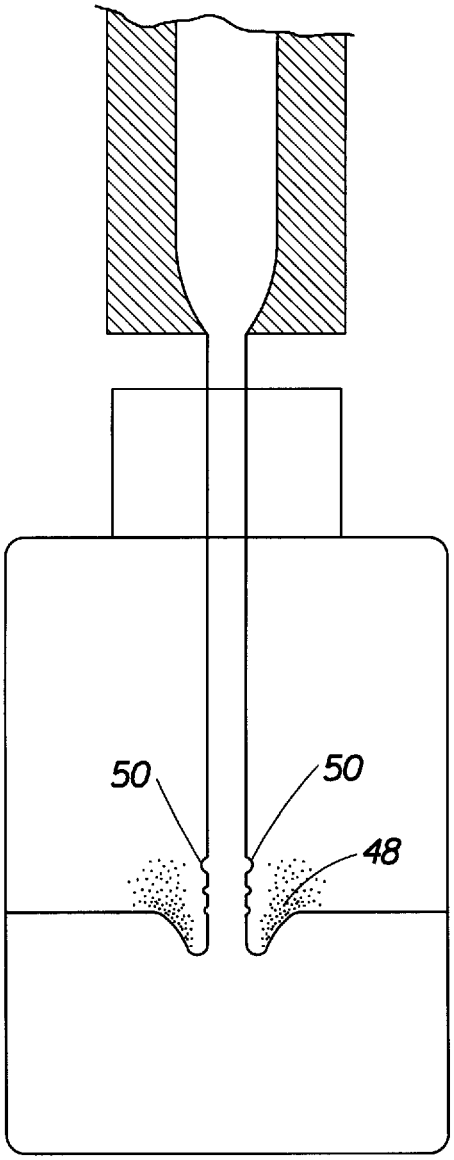
FIG. 4 is a depiction prior art of foam creation as turbulent flow fills a container.

Referring to FIG. 3, middle shroud 26 may be equipped with hydrodynamic fins 45 both above and below ribs 46. Ribs 46 provide for structural rigidity, and fins 45 help to prevent ribs 46 from introducing additional turbulence into the flow stream. FIG. 4 represents the creation of foam 48 by stream surface perturbations 50 in prior art nozzles.

While particular embodiments of the present invention have been illustrated and described herein it will be obvious to those skilled in the art that various changes and modifications can be made without departing from the spirit and scope of the present invention and it is intended to cover in the appended claims all such modifications that are within the scope of this invention.

What is claimed is:

1. A fluid flow nozzle for dispensing fluids from a container filling machine, the nozzle being capable of transforming substantially turbulent fluid flow to substantially laminar fluid flow, the nozzle comprising a hollow housing forming an inner chamber, and a torpedo-like member, the torpedo-like member being positioned within the chamber so as to define a flow annulus and restrict fluid flow through the nozzle in such as way as to dampen turbulence out of the fluid in the nozzle.

2. The nozzle of claim 1, wherein the housing comprises a fluid exit port.

3. The nozzle of claim 2, further comprising an actuator, located within the torpedo-like member, the actuator being attached to a reciprocating sealing member, the reciprocating sealing member being capable of opening and closing the fluid exit port.

4. The nozzle of claim 1, wherein fluid in the nozzle accelerates through the nozzle as the fluid flows past the torpedo-like member.

5. The nozzle of claim 2, wherein fluid in the nozzle accelerates through the nozzle as the fluid flows past the torpedo-like member.

6. The nozzle of claim 3, wherein fluid in the nozzle accelerates through the nozzle as the fluid flows past the torpedo-like member.

* * * * *